US007497255B2

(12) United States Patent
Filippov et al.

(10) Patent No.: US 7,497,255 B2
(45) Date of Patent: Mar. 3, 2009

(54) HIGH PERFORMANCE EXPANDABLE TUBULAR SYSTEM

(75) Inventors: Andrei Gregory Filippov, Houston, TX (US); Scott Anthony Benzie, Houston, TX (US); Dimitri Andrei Filippov, Houston, TX (US)

(73) Assignee: Mohawk Energy Ltd., Houston, TX (US)

( * ) Notice: Subject to any disclaimer, the term of this patent is extended or adjusted under 35 U.S.C. 154(b) by 3 days.

(21) Appl. No.: 11/691,375

(22) Filed: Mar. 26, 2007

(65) Prior Publication Data

US 2007/0221374 A1 Sep. 27, 2007

Related U.S. Application Data

(60) Provisional application No. 60/786,328, filed on Mar. 27, 2006.

(51) Int. Cl.
*E21B 23/04* (2006.01)
*B21D 39/08* (2006.01)

(52) U.S. Cl. ..... 166/207; 166/384; 166/212; 72/58; 72/370.06; 29/523

(58) Field of Classification Search ..... 166/206–208, 166/380, 382, 384, 212, 55.7; 72/370.01, 72/370.06, 393, 391.2, 58; 29/522.1, 523; 285/382.4, 258, 256
See application file for complete search history.

(56) References Cited

U.S. PATENT DOCUMENTS

| | | | | |
|---|---|---|---|---|
| 2,350,973 | A | 6/1944 | Brumleu et al. | |
| 3,191,668 | A | 6/1965 | Lorenz | |
| 3,191,680 | A | 6/1965 | Vincent | |
| 3,203,451 | A | 8/1965 | Vincent | |
| 4,678,035 | A | 7/1987 | Goldschild | |
| 5,348,095 | A | 9/1994 | Worrall et al. | |
| 6,085,838 | A | 7/2000 | Vercaemer et al. | |
| 6,631,759 | B2 | 10/2003 | Cook et al. | |
| 6,631,769 | B2 | 10/2003 | Cook et al. | |
| 6,640,903 | B1 | 11/2003 | Cook et al. | |
| 6,695,012 | B1 | 2/2004 | Ring et al. | |
| 6,892,819 | B2 | 5/2005 | Cook et al. | |
| 7,172,019 | B2 * | 2/2007 | Cook et al. | 166/207 |
| 7,185,701 | B2 | 3/2007 | Mackenzie | |

(Continued)

FOREIGN PATENT DOCUMENTS

| | | |
|---|---|---|
| WO | WO2004/099561 | 11/2004 |

(Continued)

OTHER PUBLICATIONS

Notice of Allowance issued for U.S. Appl. No. 11/734,167, with filing date of Apr. 11, 2007.

(Continued)

*Primary Examiner*—Kenneth Thompson
(74) *Attorney, Agent, or Firm*—Tumey L.L.P.

(57) ABSTRACT

A method and apparatus for tubular expansion are disclosed. In an embodiment, an apparatus for radially expanding a tubular comprises at least two expansion swages. At least one expansion swage is axially movable relative to other expansion swages. In addition, the apparatus includes sealing means capable of providing fluid tight pressure chambers between the expansion swages and an expanded portion of the tubular.

20 Claims, 2 Drawing Sheets

U.S. PATENT DOCUMENTS

| | | | |
|---|---|---|---|
| 2004/0040721 | A1 | 3/2004 | Maguire et al. |
| 2004/0112589 | A1 | 6/2004 | Cook et al. |
| 2004/0149442 | A1 | 8/2004 | Mackenzie |

FOREIGN PATENT DOCUMENTS

| | | |
|---|---|---|
| WO | WO2007/056732 | 5/2007 |

OTHER PUBLICATIONS

USPTO Office Action for U.S. App. No. 11/734,167, Dated Aug. 26, 2008.

Office Action for U.S. Appl. No. 11/734,167, dated May 30, 2008.

* cited by examiner

HIGH PERFORMANCE EXPANDABLE TUBULAR SYSTEM

CROSS-REFERENCE TO RELATED APPLICATIONS

This application is a non-provisional of U.S. Application Ser. No. 60/786,328 filed on Mar. 27, 2006, which is incorporated by reference herein in its entirety.

STATEMENT REGARDING FEDERALLY SPONSORED RESEARCH OR DEVELOPMENT

Not applicable.

BACKGROUND OF THE INVENTION

1. Field of the Invention

This invention relates to the field of expandable tubulars and more specifically to the field of expanding tubulars with multiple expansion swages.

2. Background of the Invention

Expandable tubulars have become a viable technology for well drilling, repair, and completion. In a conventional technique for expansion, an expansion swage is positioned inside a pre-expanded portion of a tubular that is sealed at the bottom with a plug. Hydraulic pressure is applied through the drill pipe into the pre-expanded portion of the tubular generating sufficient force to propagate the expansion swage and radially expand the unexpanded portion of the tubular. Drawbacks to such conventional technique include that the expansion pressure may be limited by the yield pressure of the expanded portion of the tubular, which may limit the degree of expansion. Further drawbacks include the ratio of the expandable tubular diameter to its wall thickness, which may be due to the maximum pressure available on drilling rigs. Consequently, conventional techniques may typically be limited to expansion ratios of 10-16% and to a collapse resistance of 3,000-4,000 psi.

Other conventional techniques for expansion include using a hydraulic actuator to generate force for propagating an expansion swage and radially expanding a tubular. The force is applied against a front anchor or a back anchor, which results in compressive or tensile stresses in the tubular. The connectors in the expandable tubulars, due to geometrical constraints, are typically of flush or a near flush type, which typically results in a tensile efficiency of 50%. Drawbacks include that the expansion force may not be higher than 50% of the tubular body yield strength, which may limit the degree of tubular expansion to 25-28%.

Another technique includes lowering the friction coefficient (i.e., by lubricants) between the tubular and the expansion swage, which may reduce the value of the friction factor. Drawbacks include the cost and efficiency of such a technique.

Consequently, there is a need for a technique that provides expandable tubulars with significantly higher performance characteristics, including collapse resistance, and higher expansion ratios.

BRIEF SUMMARY OF SOME OF THE PREFERRED EMBODIMENTS

These and other needs in the art are addressed in one embodiment by an apparatus for radially expanding a tubular. The apparatus includes at least two expansion swages. At least one expansion swage is axially movable relative to other expansion swages. In addition, the apparatus includes sealing means capable of providing fluid tight pressure chambers between the expansion swages and an expanded portion of the tubular.

In another embodiment, these and other needs in the art are addressed by an apparatus for radially expanding a tubular. The apparatus includes at least two expansion swages. In addition, at least one expansion swage is axially movable relative to the other expansion swages. Moreover, the apparatus includes at least one actuator that is capable of providing a force for providing longitudinal movement of at least one of the expansion swages inside the tubular to plastically radially expand the tubular.

An additional embodiment that addresses these and other needs in the art includes an apparatus for radially expanding a tubular. The apparatus includes at least two expansion swages. At least one expansion swage is axially movable relative to the other expansion swages. In addition, the apparatus includes a driving means capable of providing a force for providing sequential longitudinal movement of the expansion swages inside the tubular to plastically radially expand the tubular.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

NOTATION AND NOMENCLATURE

Figure 1:
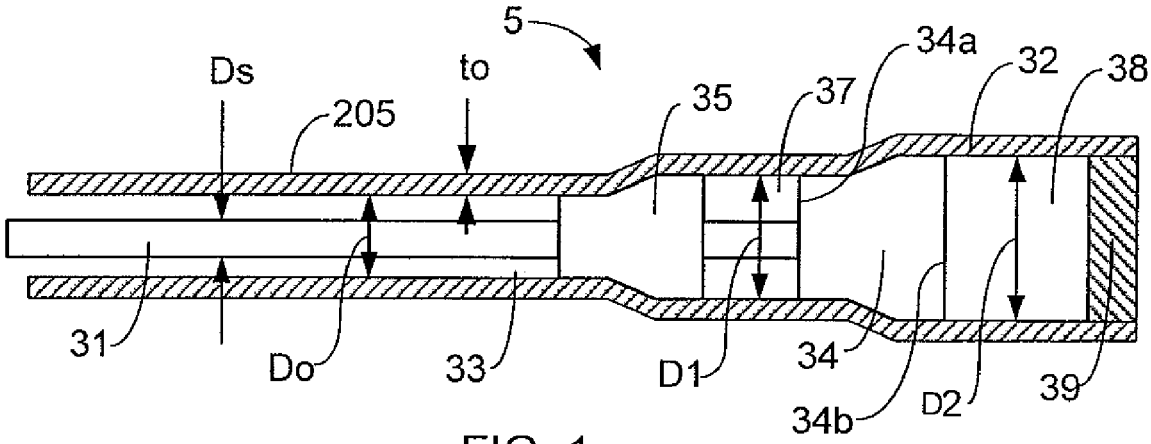
FIG. 1 illustrates a fragmentary sectional view of a tubular expansion apparatus.

"Actuator" refers to a device comprising one or more annular pistons and a cylinder slidingly arranged over the pistons, having at least one pressure chamber per piston, and capable of providing a force to axially move an expansion swage inside the expandable tubular to plastically radially expand the tubular.

"Anchor" refers to a device capable of being selectively engaged with the inner surface of the tubular and preventing movement of selected parts of the tubular expansion apparatus relative to the tubular under applied forces during the expansion process.

"Driving mean" refers to a device such as a pressure chamber, an actuator, an electric motor, a mud motor, a mechanical pull, and the like, capable of providing a sufficient force to axially move the expansion swage inside the expandable tubular to plastically radially expand the tubular.

"Expandable tubular" and "tubular" refer to a tubular member such as a liner, casing, borehole clad to seal a selected zone, and the like that is capable of being plastically radially expanded by the application of a radial expansion force.

"Expansion swage" refers to a device that may generate sufficient radial forces to plastically increase tubular diameter when it is displaced in a longitudinal direction in the tubular. Without limitation, an example of a suitable expansion swage includes a tapered cone of a fixed or a variable diameter.

"Sealing means" refers to a device such as a rubber O-ring, a polymer cup-seal, a differential fill-up collar, a metal-to-metal seal, a plug in the tubular, and the like for providing a pressure chamber.

DETAILED DESCRIPTION OF THE PREFERRED EMBODIMENTS

In an embodiment, a tubular expansion apparatus comprises at least two expansion swages. It has been found through theoretical modeling and experimentation that expansion force, F exp., maybe evaluated by equation (1).

$$F\,\text{exp.}=\pi\cdot k\cdot Yp\cdot to\cdot(Dc-Do) \tag{1}$$

k is an experimentally defined factor depending on the coefficient of friction between the tubular and swage and shape of the swage, Yp is yield stress of tubular material, $t_O$ is wall thickness of tubular in front of the swage, Dc is swage diameters and $D_O$ is tubular inner diameter in front of the swage.

The pressure for the swage propagation and expansion of the tubular may be calculated by dividing expansion force, equation (1), by the swage cross-sectional area as shown by equation (2).

$$Pexp. = 4\cdot k\cdot Yp\cdot to\cdot\frac{(Dc-Do)}{(Dc)^2} \tag{2}$$

One of the drawbacks of conventional techniques of tubular expansion may be due to the limitation of rig pressure, which may result in limited performance of expanded tubular such as collapse resistance. Under normal operating conditions, due to safety reasons and equipment limitations, the maximum operational pressure on the rig may be limited to a certain value, P max. Thus, the maximum expansion pressure is limited to the expression of equation (3).

$$\text{P exp.}\leqq\text{P max}$$

The main parameter that controls tubular collapse resistance after expansion is the ratio of tubular outside diameter, ODexp., to its wall thickness, texp. To calculate this ratio, the tubular expansion ratio, ϵ, of equation (4) may be used.

$$\varepsilon = \frac{(Dc-Do)}{Do} \tag{4}$$

It is to be understood that when a tubular is expanded in the radial direction, it may shrink in the longitudinal direction, and its wall thickness becomes thinner depending on the boundary conditions. For the most constrained conditions, such as when the tubular is differentially stuck and constrained from longitudinal shrinkage, the deformation of wall thinning is equal to the radial deformation as shown by equation (5).

$$t\,\text{exp.}=(1-\epsilon)\cdot to \tag{5}$$

texp. is tubular wall thickness after expansion. Using equations (2), (4) and (5) the condition of expression (9) may be written as equation (6).

$$\frac{ODexp.}{texp.} \geq \frac{Yp}{P\text{max.}}\cdot 4\cdot k\cdot\frac{\varepsilon}{(1-\varepsilon^2)}+2 \tag{6}$$

Where OD exp. is outside diameter of expandable tubular, ODexp. may be expressed as equation (7).

$$OD\,\text{exp.}=D\,\text{exp.}+2\cdot t\,\text{exp.} \tag{7}$$

Dexp. is inner tubular diameter after expansion, substantially equal to the swage diameter, $D_C$. Equation (6) allows calculation of the minimum ratio of the expanded pipe diameter to its wall thickness, which is a parameter for calculation of the collapse resistance of the pipe. For example, for typical values of P max.=5,000·psi, k=1.85, Yp=80,000·psi, and 20% radial expansion, equation (6) yields equation (8).

$$\frac{ODexp.}{texp.} \geq 26.7 \tag{8}$$

Using an API 5C3 formula for collapse resistance, Pc, of the expanded tubular, we have the expression of (9).

$$\text{Pc}\leqq 2{,}500\cdot\text{psi} \tag{9}$$

Therefore, the maximum collapse resistance of tubulars expanded 20% by conventional techniques, due to 5,000 psi rig pressure restriction, may be limited to 2,500 psi.

Another drawback on the degree of tubular radial expansion by conventional techniques is the limited efficiency of expandable tubular connectors. Due to geometrical constraints, the connectors of expandable tubulars are flush or near-flush, which may limit their tensile efficiency to 50% of the tubular body yield strength, Fy. Therefore, the expansion force may be limited to the constraint of (10).

$$F\,\text{exp.}\leqq 0.5\cdot Fy \tag{10}$$

The tubular body yield strength may be estimated as equation (11).

$$Fy = \frac{\pi}{4}\cdot[(OD)^2-(ID)^2]\cdot Yp \tag{11}$$

OD is outside diameter, and ID is inside diameter of unexpanded tubular. Using equations (1), (4), and (11), the constraint (10) yields expression (12).

$$\varepsilon \leq \frac{0.5}{k}\left(1+\frac{to}{Do}\right) \tag{12}$$

For expandable tubulars of practical interest with $10\leqq D_O/t_O\leqq 25$ and k=1.85, equation (12) shows that the maximum expansion ratio due to connector efficiency may be limited to the expression of (13).

$$\epsilon\leqq 30\% \tag{13}$$

The above analysis shows that the limitation on the maximum degree of radial expansion and performance characteristics of the expanded tubulars may be a result of high expansion forces or expansion pressures for tubular expansion by conventional techniques. The analysis also shows that reducing the expansion force by selecting low yield (Yp) tubulars may not eliminate the problem because both tubular body yield strength, equation (11), and expansion force, equation (1), linearly depend on Yp, and therefore the limitations may not be affected. Thus, the most effective way for overcoming the drawbacks discussed above is to employ multiple, sequential expansions of the tubular, each at a relative expansion ratio lower than the final degree of expansion.

FIG. 1 illustrates an embodiment of a tubular expansion apparatus 5 that provides multiple expansions. Tubular expansion apparatus 5 includes expansion swages 34 and 35 working sequentially. First expansion swage 35 has diameter D1, which is less than the diameter D2 of second expansion swage 34. Expanded portion 32 of tubular 205 comprises a pressure plug 39, and both expansion swages 34 and 35 are pressure sealed against the inside surface of tubular 205 providing two pressure chambers 37 and 38. The pressure is applied sequentially either in both pressure chambers 37 and 38 or only in one chamber 38. The alternating of pressure is accomplished by a valve (not shown). It is to be understood that in some embodiments the valve may be adapted to selectively control the flow of operating fluid to at least one of the pressure chambers 37, 38 and fluid outflow from chamber 37 depending on the relative positions of expansion swages 34, 35. First expansion swage 35 may slide over shaft 31, while second expansion swage 34 is permanently attached to shaft 31. In an embodiment, shaft 31 has at least two longitudinal bores for flow of operating liquid to and from pressure chambers 37, 38. If the pressure is applied to both chambers 37 and 38, second expansion swage 34 has equal pressure in back 34*b* and in front 34*a* and, therefore, second expansion swage 34 does not move with regard to tubular 205. Pressure in chamber 37 may be higher than or equal to the pressure in tubular annulus 33. At a certain level of pressure differential, first expansion swage 35 is propelled in tubular 205 sliding over shaft 31 and expanding tubular 205 from its original inside diameter Do to the diameter D1. At the end of the stroke, the valve releases pressure from chamber 37 and allows free passage of the liquid from chamber 37, while the pressure in chamber 38 is maintained. At a certain level of pressure, second expansion swage 34 is propelled expanding tubular 205 from diameter D1 to diameter D2 and moves shaft 31 through first expansion swage 35, which is stationary relative to tubular 205.

To minimize the pressure for expanding tubular 205 from its original diameter Do to the final diameter D2, the diameters of first and second swages 35 and 34 may be selected such that the pressure for the propagation of first expansion swage 35 is equal to the pressure for the propagation of second expansion swage 34. The force, F1, for the propagation of first expansion swage 35 may be calculated using equation (1) with Dc=D1, as shown by equation (14).

$$F1=\pi\cdot k\cdot Yp\cdot to\cdot(D1-Do) \tag{14}$$

Then, the expansion pressure, P1, for the propagation of first expansion swage 35 is calculated by dividing propagation force F1 by the cross-sectional area of first expansion swage 35 minus cross-sectional area of shaft 31 as shown by equation (15).

$$P1 = 4\cdot k\cdot Yp\cdot to\cdot\frac{(D1-Do)}{((D1)^2-(Ds)^2)} \tag{15}$$

Ds is a diameter of shaft 31 over which first expansion swage 35 is sliding. The force, F2, to propagate second expansion swage 34 is also calculated using equation (1) with, Dc=D2, $D_O$=D1, and $t_O=t_1$, where $t_1$ is wall thickness of tubular 205 after expansion by first expansion swage 35 as shown by equation (16).

$$F2=\pi\cdot k\cdot Yp\cdot t_1(D2-D1) \tag{16}$$

The corresponding expansion pressure, P2, for second expansion swage 34 is calculated by dividing expansion force F2 by the fill cross-sectional area of second expansion swage 34 as shown by equation (17).

$$P2 = 4\cdot k\cdot Yp\cdot t_1\cdot\frac{(D2-D1)}{(D2)^2} \tag{17}$$

Equating pressure P1 from equation (15) and pressure P2 from equation (17) (ignoring changes in wall thickness) yields the expression of equation (18).

$$\frac{(D1-Do)}{((D1)^2-(Ds)^2)} = \frac{(D2-D1)}{(D2)^2} \tag{18}$$

For a selected tubular with inside original diameter Do and selected final diameter after expansion D2, this equation (18) defines the diameter D1 of the first swage. The expansion pressure may be defined by equations (15) or (17). Equations (2) and (17) show that the expansion pressure provided by tubular expansion apparatus 5 is significantly less than the expansion pressure of conventional methods. This allows expansion of pipes with significantly lower diameter to wall thickness ratios, which results in expanded tubulars with collapse resistance significantly higher than that of tubulars expanded by conventional methods. For instance, consider the instance in which expansion pressure is limited by the maximum available rig pressure, see equation (3). When the tubular is expanded by 20%, the expression of equation (19) is provided, $$D2=1.2\cdot Do \tag{19}$$

and for the selected shaft diameter Ds=0.5·Do, equation (18) defines the diameter of first expansion swage D1=1.077·Do. Then, the condition of maximum available pressure, equation (3), using equation (17), may be written as equation (20).

$$\frac{Do}{to} \geq 0.315\cdot k\cdot\frac{Yp}{P\max} \tag{20}$$

Assigning values of friction factor k=1.85, yield stress Yp=80·ksi, and maximum available pressure P max=5,000·psi, the same as in the example of conventional expansion methods, the expression of equation (21) has been found.

$$\frac{Do}{to} \geq 9.3 \tag{21}$$

Therefore, the minimum ratio of outside diameter to the wall thickness of the pipe after 20% expansion is shown by equation (22).

$$\frac{ODexp.}{texp.} \geq \frac{(1+0.2)\cdot Do}{(1-0.2)\cdot to} + 2 = 16 \quad (22)$$

Using an API 5C3 formula for collapse resistance, Pc, of the expanded tubular yields the expression of equation (23).

$$Pc = 8{,}018 \cdot \text{psi} \quad (23)$$

Thus, utilizing the same pressure as in the conventional methods, tubular expansion apparatus 5 allows expansion of tubulars with significantly thicker walls, which results in greater than 3 times higher collapse resistance of the expanded tubular than that achievable by conventional methods.

Figure 2A:
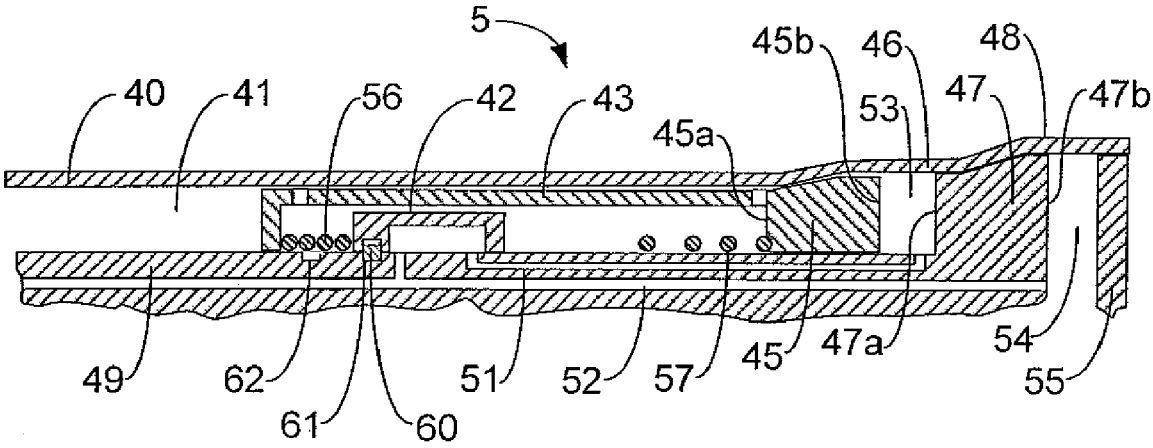
FIGS. 2A-2C illustrate a cross-sectional view of a tubular expansion apparatus shown in various stages of operation thereof.
Figure 2B:
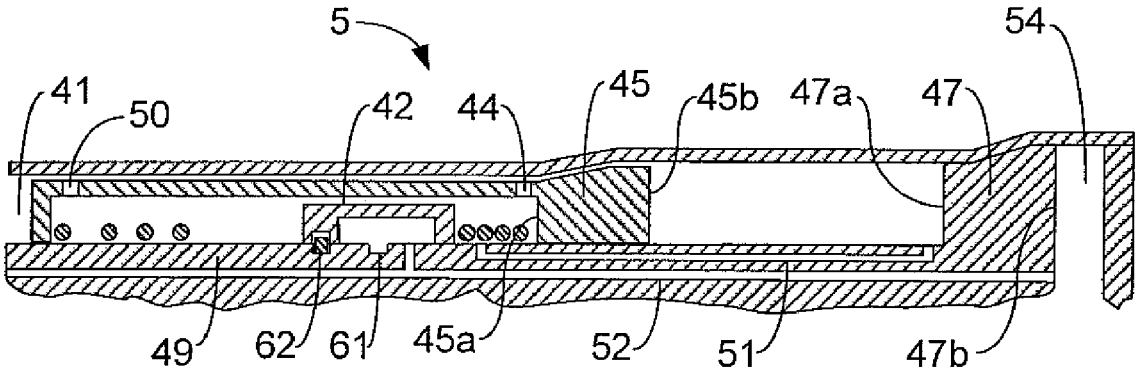
Figure 2C:
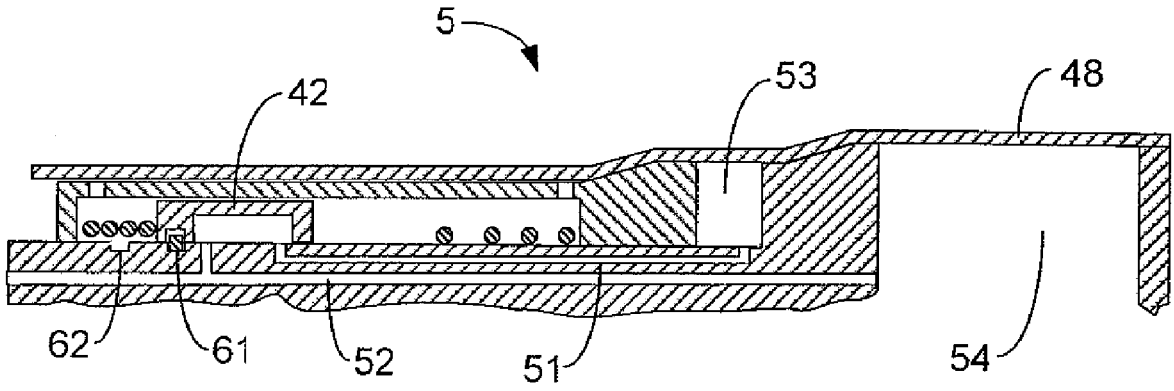

FIGS. 2A-2C illustrate cross-sectional views of tubular expansion apparatus 5 in various stages of operation. Tubular expansion apparatus 5 includes first expansion swage 45 and second expansion swage 47. First expansion swage 45 has an elongated arm 43 and may slide along shaft 49. Second expansion swage 47 is connected to shaft 49. Expanded end 48 of tubular 40 is sealed with pressure plug 55. Both first expansion swage 45 and second expansion swage 47 are sealed against tubular 40 and against shaft 49, thus comprising two pressure chambers 53 and 54. Tubular expansion apparatus 5 also includes a valve 42 capable of connecting and disconnecting pressure lines 51 and 52, depending on the relative position of first expansion swage 45 and second expansion swage 47.

As shown in FIGS. 2A-2C, the pressurized fluid is supplied through a conduit such as drill pipe or coiled tubing to pressure line 52. When valve 42 is in its end position connecting pressure line 52 with line 51, as shown in FIG. 2A, the pressure is applied in both pressure chambers 53 and 54. In this position, pressure is applied to both front side 47*a* and back side 47*b* of second expansion swage 47, and it remains stationary with regard to tubular 40. First expansion swage 45 is under high pressure on back side 45*b* by pressure chamber 53 and under low pressure on front side 45*a* equal to the pressure in annulus 41. At a certain level of pressure differential applied to first expansion swage 45, first expansion swage 45 starts sliding over shaft 49 expanding tubular 40 to provide expanded portion 46. At the end of the stroke, first expansion swage 45 displaces valve 42 to the end position in which pressure lines 51 and 52 are disconnected, as shown in FIG. 2B. Under theses conditions, liquid from front side 45*a* and back side 45*b* is communicating with annulus 41 through vents 44 and 50, and therefore, first expansion swage 45 remains stationary with regard to tubular 40. Second expansion swage 47 is exposed to high pressure on back side 47*b* from pressure chamber 54 and low pressure on front side 47*a*, equal to the pressure in annulus 41. At a certain pressure differential, second expansion swage 47 moves forward with shaft 49 sliding through first expansion swage 45 and expanding tubular 40 to provide expanded portion 48. As shown in FIG. 2C, at the end of the stroke, valve 42 is displaced to the end position in which pressure lines 51 and 52 are connected, and which is the same position as in the beginning of the cycle as shown in FIG. 2A. Thus, tubular expansion apparatus 5 provides automatic sequential movement of expansion swages 45, 47 under continuous supply of pressurized fluid through pressure line 52. By selecting diameters D1, D2 of expansion swages 45, 47 by equation (24) the operational expansion pressure may be minimal and practically constant.

As shown in FIG. 2A, valve 42 is a hydraulic valve and includes a cylinder longitudinally slidably engaged with shaft 49 and forming an internal annular pressure chamber surrounding shaft 49. Valve 42 is a two-position valve with a first position corresponding to a pressure supply to both pressure chambers 53 and 54, and a second position corresponding to pressure supply to only pressure chamber 54 and allowing liquid flow from pressure chamber 53 to annulus 41. In an embodiment, valve 42 includes a position control device (not illustrated) to selectively and releasably lock the cylinder in first or second positions This may be achieved, for example, by utilizing a C-ring locking mechanism. As shown in FIG. 2A, C-ring 60 may be engaged or disengaged in grooves 61 or 62 under the action of an axial force applied to valve 42 through the action of springs 56 and 57. It will be understood that C-ring 60 may bear against any suitable surfaces or any components having fixed relationship with shaft 49 and/or with the valve cylinder. C-ring 60 may be configured to operate primarily in tension or primarily in compression. It will also be understood that other position control devices, such as a collets and the like, capable of selectively and releasably securing a position of the valve cylinder on shaft 49 may be used.

The shifting between the end positions of valve 42 is provided by the relative displacement of expansion swages 45 and 47. The length of elongated arm 43 may generally be equal to the length of the total stroke displacement between expansion swages 45, 47. Each spring 56, 57 is capable of displacing valve 42 from the first valve position to the second valve position and vice versa. It will be understood that springs 56 and 57 may bear against any suitable surfaces or any components having a fixed relationship with valve 42 and/or with elongated arm 43. Springs 56 and 57 may be configured to operate primarily in tension or primarily in compression. It will also be understood that any other type of valve may be used that is suitable for alternating the pressure and liquid outflow from the chamber between expansion swages 45, 47 depending on relative position of expansion swages 45, 47.

Figure 3:
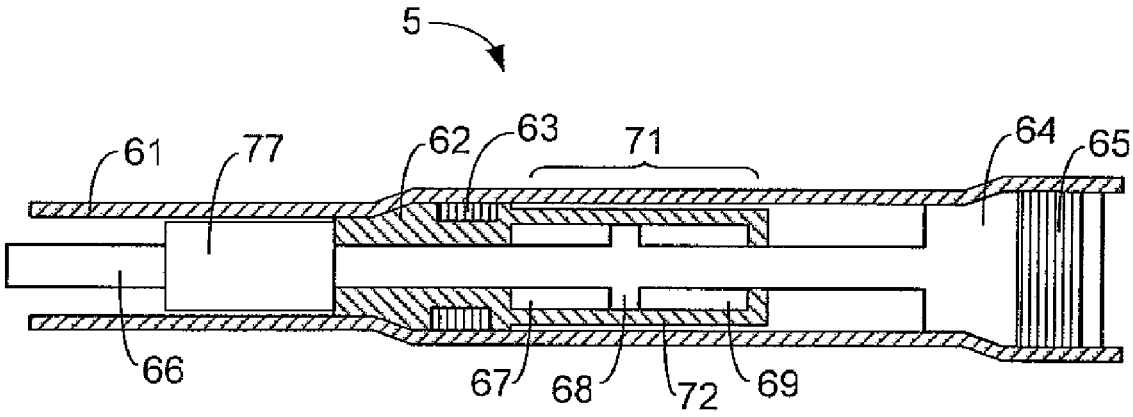
FIG. 3 illustrates a fragmentary sectional view of a tubular expansion apparatus employing an actuator.

FIG. 3 illustrates another embodiment of tubular expansion apparatus 5, which shows a fragmentary sectional view of tubular expansion apparatus 5 with expansion swages 62 and 64. Tubular expansion apparatus 5 also comprises anchors 63 and 65 capable of being selectively anchored to the inner surface of tubular 61. Tubular expansion apparatus 5 also comprises an actuator 71 including a cylinder 72 attached to expansion swage 62 and a piston 68 attached to shaft 66 and a two position hydraulic valve 77, for instance as disclosed in Application PCT/US2006/060624 which is incorporated by reference herein in its entirety, capable of alternating pressure and fluid outflow from pressure chambers 67 and 69. When pressure is applied in pressure chamber 67, fluid is vented from pressure chamber 69, and anchor 65 is anchored against tubular 61 while anchor 63 is disengaged. At a certain level of pressure, first expansion swage 62 moves inside tubular 61 and expands it to a diameter substantially equal to the diameter, D1, of first expansion swage 62 while second expansion swage 64 remains stationary with regard to tubular 61. At the end of the stroke, the pressure is applied to pressure chamber 69 while the fluid from pressure chamber 67 is vented, and anchor 63 is anchored to tubular 61 while anchor 65 is disengaged. At a certain level of pressure, second expansion swage 64 moves inside tubular 61 and expands it to a diameter substantially equal to the diameter, D2, of second expansion swage 64, while first expansion swage 62 remains stationary with regard to tubular 61. Thus, expansion swages 62, 64 move inside tubular 61 in sequential manner expanding tubular 61 from its original inside diameter Do to the diameter D1 and then from D1 to D2. To minimize expansion forces, for expansion of a selected tubular of unexpanded diameter Do to a final expanded diameter D2, the diameter, D1, of first expansion swage 62 may be defined from the condition that expansion forces for expansion by each swage should be equal. Equating forces F1 from equation (14) and F2 from equation (16) and ignoring changes in wall thickness, equation (24) is obtained.

$$D1 = \frac{Do + D2}{2} \tag{24}$$

Equation (24) defines the relationship between diameters of first and second expansion swages 62 and 64. Equation (24) also provides the minimum expansion force for tubular radial expansion by two swages. If diameters of the swages are selected according to equation (24), the expansion force calculated using equation (14) becomes equation (25).

$$F1 = \pi \cdot k \cdot to \cdot Yp \cdot \frac{(D2 - Do)}{2} \tag{25}$$

The expansion force to expand the same tubular to the same diameter, D2, using a conventional swage technique, calculated by equation (1) with Dc=D2 and $D_f$=Do is shown by equation (26).

$$F\text{exp.} = \pi \cdot k \cdot to \cdot Yp \cdot (D2 - Do) \tag{26}$$

Comparison of equations (25) and (26) shows that the force for tubular expansion by tubular expansion apparatus 5 may be half of the force for expansion of the same tubular to the same degree of expansion by a conventional expansion technique.

Selecting the diameters of swages according to equation (24) and using the expansion ratio defined as equation (27), $$\varepsilon = \frac{(D2 - Do)}{Do} \tag{27}$$

the limitation on maximum degree of expansion due to the constraint of connector efficiency, shown by constraint (10), may be obtained by substituting expansion force from equation (25) in constraint (10) and shown by equation (28).

$$\varepsilon \leq \frac{1}{k}\left(1 + \frac{to}{Do}\right) \tag{28}$$

For the same values of k=1.85 and Do/to=10 as in the case of conventional expansion methods, shown by equation (13), the maximum degree of tubular expansion, equation (28), may be estimated as expression (29).

$$\epsilon \leqq 60\% \tag{29}$$

Thus, the maximum degree of radial expansion of a tubular by tubular expansion apparatus 5 may be double the maximum degree of expansion by the conventional expansion techniques, see equation (19).

It will be further appreciated by those skilled in the art that the tubular expansion apparatus 5 comprising multiple expansion swages working in a sequential manner described herein may employ any conventional swages such as, but not limited to, swages of fixed or variable diameters. Additionally, the driving means may employ hydraulic pressure, hydraulic actuators, electric motors, mud motors, mechanical pull force, or combinations thereof.

It is to be understood that in some embodiments tubular expansion apparatus 5 has two or more actuators for providing suitable force for longitudinal movement of at least one of the expansion swages. It is to be further understood that expansion of the tubular may include plastic radial expansion of the tubular.

Without being limited by theory, tubular expansion apparatus 5 provides an expansion pressure 35-40% less than the expansion pressure for the same degree of tubular expansion accorded to conventional expansion methods. Further, without being limited by theory, tubular expansion apparatus 5 allows expansion of the tubular with lower ratios of tubular diameter to tubular wall thickness, which may result in expanded tubulars with collapse resistance 2-3 times higher than the collapse resistance of tubulars expanded by conventional methods.

Although the present invention and its advantages have been described in detail, it should be understood that various changes, substitutions and alterations may be made herein without departing from the spirit and scope of the invention as defined by the appended claims.

What is claimed is:

1. An apparatus for radially expanding a tubular comprising:

at least two expansion swages, wherein at least one expansion swage is axially movable relative to other expansion swages;

sealing means capable of providing fluid tight pressure chambers between the expansion swages and an expanded portion of the tubular; and at least one hydraulic valve adapted to selectively control the flow of operating fluid to at least one of the pressure chambers between the expansion swages and fluid outflow from the chambers depending on the relative positions of the expansion swages.

2. The apparatus of claim 1, comprising a shaft having at least two longitudinal bores for flow of operating liquid to and from the pressure chambers.

3. The apparatus of claim 2, wherein at least one expansion swage is axially movable along the shaft and another expansion swage is connected to the shaft.

4. The apparatus of claim 1, wherein the sealing means comprise a pressure plug in the expanded portion of the tubular.

5. The apparatus of claim 1, further comprising a shaft, wherein the hydraulic valve comprises:

a valve cylinder slidably positioned on the shaft;

a position control device capable of selectively and releasably securing end positions of the valve cylinder on the shaft; and at least one spring capable of shifting the valve cylinder between the end positions.

6. The apparatus of claim 1, wherein the at least two expansion swages comprise a first expansion swage and a second expansion swage.

7. The apparatus of claim 6, wherein a diameter of the first expansion swage is D1 and a diameter of the second exnansion swage is D2, and wherein D1 and D2 are defined by $$\frac{(D1 - Do)}{((D1)^2 - (Ds)^2)} = \frac{(D2 - D1)}{(D2)^2}$$

where Do is an inside diameter of unexpanded tubular and Ds is a diameter of the shaft.

8. The apparatus of claim 1, wherein the at least two expansion swages are sequentially movable under a continuous supply of pressurized fluid through a pressure line.

9. The apparatus of claim 1, wherein the at least one expansion swage axially movable relative to the other expansion swages comprises an elongated arm.

10. An apparatus for radially expanding a tubular comprising:

two expansion swages and a shaft, wherein one expansion swage is axially movable along the shaft relative to the other expansion swage and the other expansion swage is connected to the shaft; and at least one actuator capable of providing a force for providing longitudinal movement of at least one of the expansion swages inside the tubular to plastically radially expand the tubular, wherein the at least one actuator comprises an actuator attached to the expansion swage axially movable along the shaft.

11. The apparatus of claim 10, further comprising at least one anchoring device for selective and releasable anchoring of selected parts of the apparatus to an inner surface of the tubular.

12. The apparatus of claim 10, wherein the diameter of one expansion swage is D1 and a diameter of the other expansion swage is D2, and wherein D1 and D2 are defined by $$D1 = \frac{Do + D2}{2}$$

where Do is an inside diameter of the tubular before expansion.

13. The apparatus of claim 10, comprising two actuators, wherein each actuator is capable of providing a force for providing longitudinal movement of at least one of the expansion swages inside the tubular to plastically radially expand the tubular.

14. The apparatus of claim 13, wherein one of the actuators comprises a two position hydraulic valve.

15. An apparatus for radially expanding a tubular comprising:

at least two expansion swages, wherein at least one expansion swage is axially movable relative to the other expansion swages; and at least one actuator capable of providing a tbrce for providing longitudinal movement of at least one of the expansion swages inside the tubular to plastically radially expand the tubular, wherein the at least one actuator comprises:

one or more annular pistons attached to a shaft;

a cylinder slidingly arranged over the pistons; and at least one pressure chamber per piston.

16. The apparatus of claim 15, further comprising a shaft having at least two longitudinal bores for flow of operating liquid to and from the pressure chambers.

17. The apparatus of claim 16, wherein the at least one expansion swage is axially movable along the shaft, and wherein at least one expansion swage is connected to the shaft.

18. The apparatus of claim 15, further comprising a sealing means.

19. The apparatus of claim 15, wherein the at least one expansion swage axially movable relative to the other expansion swages comprises an elongated arm.

20. The apparatus of claim 15, wherein the at least two expansion swages are sequentially movable under a continuous supply of pressurized fluid through a pressure line.

* * * * *